United States Patent [19]

Shimodaira et al.

[11] 4,284,002

[45] Aug. 18, 1981

[54] CHARACTER-SELECTING MECHANISM FOR A PRINTER

[75] Inventors: Tadayoshi Shimodaira; Yoshihiro Mitsui, both of Shiojiri, Japan

[73] Assignees: Kabushiki Kaisha Suwa Seikosha; Shinsu Seiki Kabushiki Kaisha, both of Tokyo, Japan

[21] Appl. No.: 8,829

[22] Filed: Feb. 2, 1979

Related U.S. Application Data

[63] Continuation-in-part of Ser. No. 819,520, Jul. 27, 1977, abandoned.

[30] Foreign Application Priority Data

Jul. 27, 1976 [JP] Japan ..... 51-89482
Jan. 28, 1977 [JP] Japan ..... 52-8453

[51] Int. Cl.[3] ..... B41J 1/28
[52] U.S. Cl. ..... 101/99; 335/229
[58] Field of Search ..... 101/93.02, 93.22, 93.48, 101/95, 96, 99, 110; 335/229, 230, 234, 81, 179

[56] References Cited

U.S. PATENT DOCUMENTS

| | | | |
|---|---|---|---|
| 3,194,921 | 7/1965 | Watts | 335/179 X |
| 3,266,418 | 8/1966 | Russo | 101/93.02 |
| 3,282,203 | 11/1966 | Kalbach et al. | 335/230 X |
| 3,506,189 | 4/1970 | Breitling | 335/179 X |
| 3,710,290 | 1/1973 | Kuipers et al. | 335/234 X |
| 3,728,961 | 4/1973 | Gross et al. | 101/99 |
| 3,771,442 | 11/1973 | Ditman | 101/99 |
| 3,821,672 | 6/1974 | Sturm | 101/99 X |
| 3,864,942 | 2/1975 | Savage et al. | 335/234 X |
| 3,946,666 | 3/1976 | Yokoyoma | 101/99 |
| 3,950,718 | 4/1976 | Nagamoto | 335/234 X |
| 3,952,853 | 4/1976 | Feldman | 335/234 X |
| 3,954,055 | 5/1976 | Henaoka | 101/99 |

*Primary Examiner*—Edward M. Coven
*Attorney, Agent, or Firm*—Blum, Kaplan, Friedman, Silberman & Beran

[57] ABSTRACT

In a character-selecting mechanism for a printer, an electromagnet which controls the engagement and disengagement of a pawl with a ratchet and, thereby, the actual printing step, is supplemented with a permanent magnet having spaced-apart poles. A core arm lies within a core passage in the electromagnet and protrudes into the magnetic field produced by the permanent magnet. Activation of the electromagnet by a current pulse magnetizes the core arm to a polarity such that it is repelled by a pole next to which the core arm is disposed in a first position so that the core arm moves toward the other pole to take up a second position. During the transit from first to second position the core arm which is connected through a core member to a pawl brings the pawl into engagement with the ratchet. The energy requirement for effecting engagement of the pawl with the ratchet is substantially smaller than that of mechanisms relying on an electromagnet alone, whereby reducing both the size and the power consumption of such a printer.

8 Claims, 5 Drawing Figures

CHARACTER-SELECTING MECHANISM FOR A PRINTER

CROSS-REFERENCE TO RELATED APPLICATION

The present application is a continuation-in-part application of my co-pending application Ser. No. 819,520, filed July 27, 1977 for CHARACTER-SELECTING MECHANISM FOR A PRINTER, now abandoned.

BACKGROUND OF THE INVENTION

In conventional character-selecting mechanisms utilized in printers, a character on a printing type ring must be brought to a printing position. As part of this operation an electromagnet is activated by a current pulse to attract a plate connected to a trigger ring device which functions through engagement of a pawl with a ratchet, usually a rotating ratchet wheel.

Since the plate, in standby state, must be disengaged from the electromagnet, there must be a gap therebetween, such a gap necessitating the use of a relatively large electromagnet requiring a relatively large current to establish a sufficiently strong magnetic field to attract the plate across the gap between the electromagnet and the plate. This type of construction, consequently, results in undesirably high power consumption for operation and undesirable weight as well as production of noise during operation. As is evident, then, it would be desirable to provide a character-selecting mechanism which is low in weight, power-consumption, noise-production as well as in cost.

SUMMARY OF THE INVENTION

Generally speaking, an electromagnet for controlling engagement of a pawl with a ratchet in a character-selecting mechanism in a printer has a passage therethrough for receiving therethrough an iron core arm which is part of a core member connected to a pawl. The electromagnet is supplemented with a permanent magnet having spaced-apart pole pieces generating a magnetic field disposed for acting upon said core arm.

In a first position, corresponding to a standby position said core arm is disposed proximate one of said poles. Said electromagnet is so connected electrically that on activation by a current pulse the portion of said core arm proximate said pole takes on the same magnetic polarity as said pole so that it is repelled thereby and attracted by the other pole. The core arm is mounted so that it can move toward the other pole into a second position, thereby engaging said pawl with a ratchet. The effect of the permanent magnet and the core arm within said electromagnet is to lower the current requirement necessary for moving the core arm from said first position to said second position and thereby for engaging said pawl with said ratchet. Further, once the core arm has been moved from said first to said second position, the permanent magnet will hold the core arm in said second position so that the length of the current pulse may be shortened below that necessary in the absence of a permanent magnet.

The core arm is part of a core member which may be integral with said pawl. In another embodiment the core member has a side arm lying outside of said electromagnet. The shape of said side arm is such that when said core arm in said first position is proximate one pole of said electromagnet said side arm is proximate the other pole of said electromagnet. On application of a current pulse to said electromagnet said core arm takes on the same magnetic polarity as the pole adjacent to which it is disposed and said side arm takes on the magnetic polarity of the other pole, so that both said core arm and said side arm are repelled by the two poles of the permanent magnet, thereby increasing the force generated by a current pulse of a given power. This force may be supplemented by the biasing force of a spring, the force of said spring being insufficient to move said core member from first to second position in the absence of the force generated by a current pulse through said electromagnet.

Means for returning the core member and core arm from second position to first position are provided, such means preferably being mechanical.

In a preferred embodiment, a plurality of core members, each having a core arm and a side arm are mounted on a single shaft for printing a plurality of lines. Only two magnets are provided for operation of the substantially larger number of core members. Each core arm is disposed within its corresponding electromagnet and said electromagnets are disposed in staggered, i.e., zig-zag arrangement for minimizing the distance or pitch between said lines.

Accordingly, it is an object of the present invention to provide a character-selecting mechanism in a printer of reduced weight and power requirement.

Another object of the present invention is a character-selecting mechanism in a printer wherein an electromagnet has a core passage for receiving a core arm and is coupled with a permanent magnet for the purpose of reducing power requirement.

A further object of the present invention is a character-selection mechanism in a printer wherein a core member has a core arm within a core passage in an electromagnet, thereby providing an improved magnetic circuit of decreased power requirement and decreased weight.

An important object of the present invention is a character-selecting mechanism in a printer, said printer comprising a plurality of such mechanisms each incorporating an electromagnet and said electromagnets being disposed in a staggered array.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
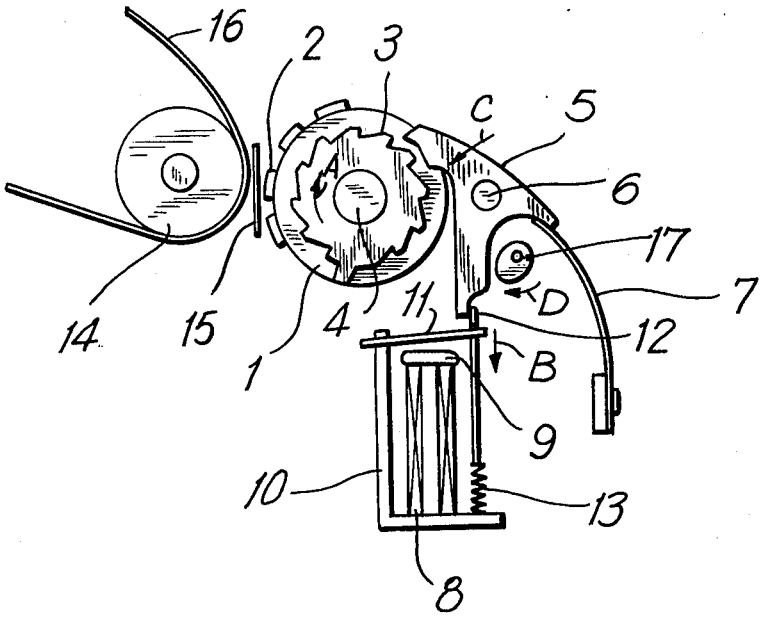
FIG. 1 PRIOR ART
FIG. 1 is a conventional character-selecting mechanism in a printer.

In a conventional character-selecting mechanism for a printer which utilizes a printing type ring, as shown in FIG. 1, a printing type ring 1 is connected to a drive shaft 4 either by friction or by spring force for rotating with said drive shaft 4. When a required character 2 on printing type ring 1 reaches printing position, selecting pawl 5 is operated to bring ring 1 to rest. To operate selecting pawl 5, a current pulse is passed through electromagnet 8 supported on frame 10 to draw plate 11 toward core 9 of electromagnet 8. The plate 11 will then move in the direction of the arrow having the reference character B. Trigger 12 will be drawn in the direction of arrow B against the biasing force of spring 13, releasing pawl 5 to rotate in the direction of arrow C around shaft 6 under the biasing force of spring 7. Pawl 5 will then engage a selected tooth on ratchet 3, bringing a selected tooth 2 to rest for printing through ink ribbon 15 on paper 16 by movement of platen 14 toward drive shaft 4. At the completion of printing, cam 17 rotating in the direction indicated by the arrow having the reference character D disengages pawl C from ratchet wheel 3 and trigger 12 re-engages pawl 5, holding same in standby or rest position.

As is evident from the above description of the operation of a conventional character-selecting mechanism, operation of selecting pawl 5 requires an electromagnet 8 constructed with an iron core 9, a yoke 10, an attracting plate 11, a trigger 12 and a biasing spring 13 so that construction is complex. Further, iron core 9 must attract plate 11 through a gap so that the power required is relatively large. Also, the force exerted by the electromagnet on the plate 11 must be sufficient to overcome the frictional load between selecting pawl 5 which is operated by the leaf-spring 7 and the operating plate 12 as well as the spring load generated by compression spring 13. These requirements make it necessary to generate a strong magnetic field, this necessity, in turn, increasing both power consumption and the weight of the system.

Figure 2:
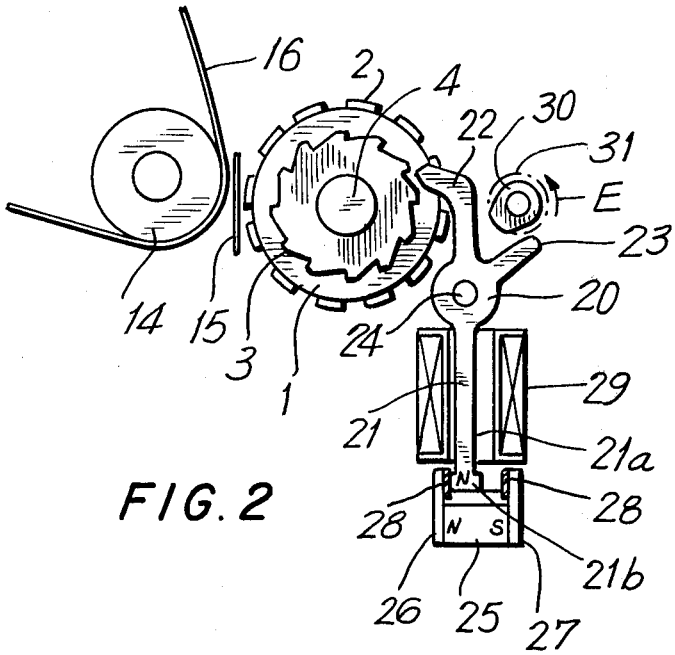
FIG. 2 is a character-selecting mechanism in accordance with the present invention wherein an electromagnet is coupled with a permanent magnet.
Figure 4:
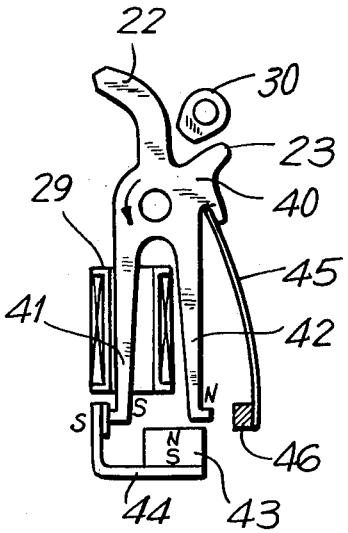
FIG. 4 is another embodiment of the present invention.

Both power requirement and weight, as well as printing noise are decreased by the mechanism shown in FIGS. 2 and 4. As shown in FIG. 2, core member 20 has a core arm 21 traversing core passage **21*a* in electromagnet coil 29. Core arm 21 is of a ferromagnetic material, preferably iron, and is movable between first and second positions by rotation around shaft 24. Core arm 21 protrudes through electromagnet coil 29 into the magnetic field generated by permanent magnet 25. Permanent magnet 25 has magnetic pole plates 26 and 27. Conveniently, each of poles 26 and 27 has a spacer 28 thereon, said spacer being of a nonferromagnetic material and, preferably, of an insulating material such as rubber or a soft plastic, the purpose of the spacer being to minimize noise and to facilitate release of core arm 21 from poles 26 and 27**.

FIG. 2 shows the character-selection mechanism in a state in which core arm 21 is in a first or standby position proximate one of said pole plates, namely, pole plate 26. For convenience, pole plate 26 is indicated as being the north pole of permanent magnet 25. When core arm 21 and core member 20 are in first position, selecting pawl 22 is disengaged from ratchet wheel 3 so that type ring 1 and the characters 2 thereon rotate with shaft 4. As is shown in FIG. 2, tip **21*b* is preferably broader than the remainder of core arm 21 in the direction from one pole plate 26 to the other pole plate 27. The reluctance of the magnetic circuit through magnet 25, pole plate 26, core tip 21*b*, pole plate 27 and back to magnet 25 is thereby decreased and the holding strength of the pole plates for the core tip 21*b*** is increased.

When selection of a character 2 for printing is to be made, an appropriately-timed current pulse is passed through electromagnet 29. The timing is effected by conventional means such as the use of an electromagnetic detector or photo-electric detector coupled with drive shaft 4 or a shaft synchronized to rotate therewith. Such means are well known to those skilled in the art.

Electromagnetic coil 29 is so connected electrically that tip **21*b* of core arm 21 becomes of the same magnetic polarity as pole plate 26, in this case, north. A repulsive force between pole plate 26 and tip 21*b* is generated and simultaneously an attractive force between tip 21*b* and pole plate 27 is generated, pole plate 27 being a south pole. These combined forces rotate core member 20 in counterclockwise direction to activated or second position and bring pawl 22 into engagement with a selected tooth on ratchet wheel 3 to bring printing type ring 1** to a halt.

A plurality of core members, also termed "reeds" are arranged in parallel, each reed being associated with a corresponding printing type ring for bringing each ring to halt with a selected character in printing position so that it is possible to print a row of characters or letters on printing paper 16. As each reed 20 moves into the second position, reset arm 23 moves into the path of a reset cam 31 which rotates in the direction of the arrow E on shaft 30. The electric pulse through electromagnet 29 is of a duration such that it will have been terminated once pawl 22 has engaged ratchet wheel 3. Although the magnetizing effect of electromagnet 29 on core arm 21 will have been terminated, pole 27 will hold tip **21*b* thereto by the normal attraction of the pole of a permanent magnet for an iron member. Disengagement of core arm 21 from pole 27 by the action of reset cam 31 returns core arm 21 to said first position in which tip 21*b* is engaged with pole 26. In this condition, there is, of course, no repulsive force between pole 26 and tip 21*b* since there is no longer electric current flowing through electromagnet 29 and tip 21*b*** is no longer a north pole.

Figure 3:
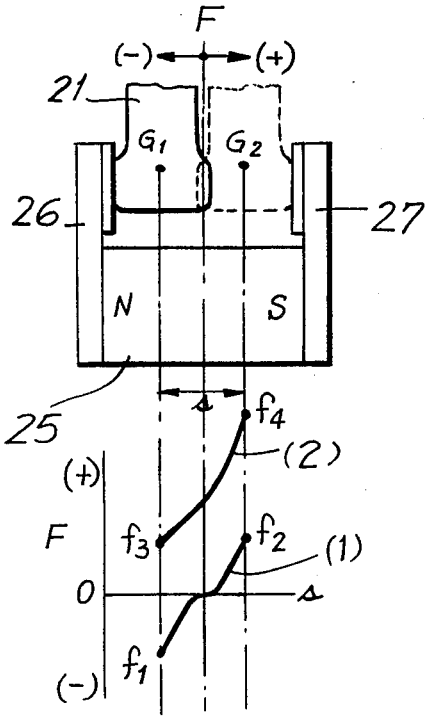
FIG. 3 shows in the upper part thereof the two positions which a core arm may occupy in relation to the poles of a permanent magnet and in the lower part thereof the force exerted by said permanent magnet on said core member as a function of position in the space between the poles of said permanent magnet, curve (1) showing the force of said core arm in the absence of an electric current in the electromagnet associated with said permanent magnet and curve (2) showing the force in the presence of an electric current in said electromagnet.

FIG. 3 shows in the upper part thereof the positional relationships between core arm 21 and magnet 25 and in the lower part thereof the total force exerted on core arm 21, curve (1) showing the force F on said core arm as a function of position of said arm when the electromagnetic coil 29 carries no current and curve (2) showing the force when current is flowing through said electromagnet.

Referring first to the upper part of FIG. 3, the center of iron core 21 moves from $G_1$ to $G_2$, $G_1$ corresponding to first position and $G_2$ corresponding to second position. The displacement s is shown in the abscissa and the force F is shown on the ordinate in the lower part of FIG. 3.

When iron core 21 is engaged with pole plate 26, that is, when it is in first position, the attractive force on core 21 will be $-f_1$. Core 21, then, is in a position corresponding to standby condition of the printing mechanism. As is evident, no spring member such as that indicated by the reference numeral 13 in FIG. 1 is necessary to maintain iron core 21 in the standby condition.

When iron core 21 is moved over into second position as indicated by the reference character $G_2$ and is engaged with magnetic pole plate 27, it will be held there by an attractive force of magnitude $+f_2$. When in engagement with pole plate 27, selecting pawl 22 is engaged with ratchet wheel 3 and iron core 21 will remain in second position even when the current through the electromagnet 29 is interrupted. Consequently, a leaf spring such as that indicated by the reference numeral 7 in FIG. 1 is unnecessary.

Curve (2) shows the force F generated when a current pulse is passing through electromagnet 29. The total force on core arm 21 is substantially larger than the force exerted by the permanent magnet alone, such force being indicated by the character $f_2$.

It will be noted from curve (1) that the force F on core arm 21 when no current is flowing through the electromagnet is 0 at the middle of the stroke s. The equilibrium at this point is unstable since a displacement in either direction will result in further displacement in the same direction. Consequently, action of the reset cam 30 at the conclusion of a printing operation is greatly facilitated since it is only necessary to displace core arm 21 past the neutral position, after which pole 26 takes over to complete the transfer of core arm 21 from second position to first position.

The effect of the permanent magnet in decreasing the load on reset cam 30 also decreases the requirement for precision in the manufacture of the character-selecting mechanism and reduces the wear on the components which takes place during resetting. In addition, pole plate 26 holds core arm 21 sufficiently firmly so that when the mechanism is in standby condition, no externally-imposed vibration or impact can result in undesired displacement of core-arm 21 since the system has a self-restoring action. Consequently, there can be no significant defect in the operation of the mechanism such as misprinting. Also, the driving circuit is simpler and cheaper than mechanisms in accordance with the prior art. Further, electrical reset can be utilized, such electrical reset being achieved by passing electric current through the electromagnet 29 in the reverse direction to that utilized in the selection step. When the current direction is reversed, tip **21*b* of core arm 21 becomes south in magnetic polarity whereupon it is repelled by pole 27 and attracted by pole 26. The net force on core arm 21 is then clockwise, disengaging pawl 22 from ratchet wheel 3 and moving core arm 21** into first position.

As is evident, a character-selection mechanism in accordance with the present invention is superior to conventional mechanisms in the following respects:

1. The presence of the permanent magnet eliminates the need for a spring member and a mounting arrangement for the spring member. It also eliminates or simplifies assembly and adjustment processes, thereby effecting a reduction in cost.
2. Coupling of a permanent magnet with an electromagnet provides both an attractive force and a repulsive force which can be utilized to reduce power consumption. Experimental tests have proved that the current can be reduced to approximately 1/5 of the conventional value (250 mA).
3. Friction is reduced by the elimination of springs and other components so that wear is reduced, reliability is increased and operation is simplified.

A second embodiment of the present invention is shown in FIG. 4 in which a core member 40 has a core arm 41 and a side arm 42 as well as a selecting pawl 22 and a reset arm 23. Permanent magnet 43 has a pole plate 44, one arm of which is bent upwardly. Core arm 41 passes through electromagnet 29 and side arm 42 lies outside electromagnet 29. Core member 40 as well as core arm 41, side arm 42, pawl 22 and reset arm 23 can move between first and second positions. The first position corresponds to standby condition in which core arm 41 is engaged with pole plate 44, labelled "south" (S) for convenience. Simultaneously, side arm 42 is proximate the pole of opposite polarity to that of pole plate 44, said pole on said electromagnet 43 being labelled "north" (N) for convenience. Electromagnet 29 is electrically connected for receiving a current pulse in a direction such that the tip of core arm 41 becomes of the same polarity as pole plate 44 while the tip of side arm 42 becomes of the same polarity as the pole of permanent magnet 43 to which it is proximate in said first condition. Pole plate 44 then repels core arm 41 while the north pole of permanent magnet 43 attracts said core arm. Simultaneously, side arm 42 is repulsed by the north pole of permanent magnet 43, thereby rotating core member 40 in a counterclockwise direction until side arm 42 makes contact with stop 46. The advantage of the embodiment of FIG. 4 is that the magnetic permeance as viewed from the electromagnet 29 is increased by providing two iron cores 41 and 42 and thereby providing a greater torque upon core member 40. Also, spring member 45 provides a biasing force to rotate core member 40 from first position to second position. Further, by the use of spring member 45 the initial turning force on core member 40 will be increased and the time of transit between first and second position is reduced.

Figure 5:
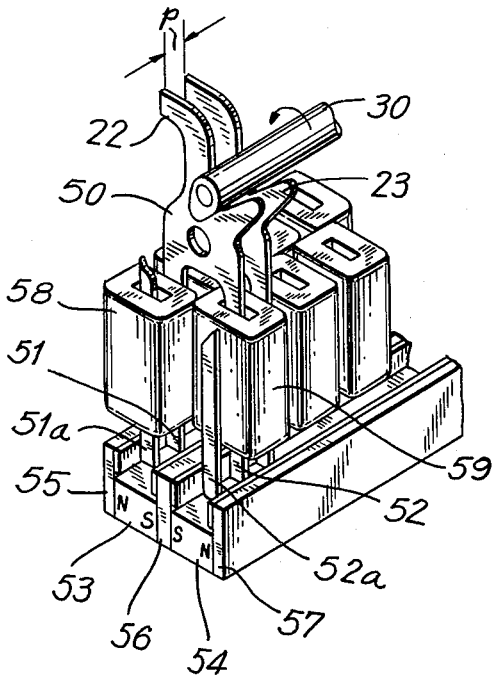
FIG. 5 is an embodiment including a plurality of such character-selecting mechanisms.

As aforenoted, a plurality of core members may be provided for printing a plurality of lines with a pitch p therebetween. In the embodiment of FIG. 5 movable core member 50 has a core arm 52 within electromagnet 59 which in standby or first position is proximate pole plate 56 common to both of permanent magnets 53 and 54. Said core member 50 also has a side arm 51 which in standby position is proximate pole plate 55 of magnet 53. As is shown in FIG. 5, the electromagnets corresponding to adjacent core members are staggered in first and second lines. Thus electromagnet 58 in said first line is offset from electromagnet 59 in said second line, said electromagnet 58 corresponding to a core member of which only core arm **51*a* and side arm 52*a*** are shown.

The staggered positioning of the electromagnets results in the core arms of each pair of adjacent core members having opposite polarities. Nevertheless, in standby position each core member has one arm proximate common pole plate 56 but within the field of permanent magnet 54 and one arm adjacent pole plate 55 of magnet 53, as viewed in FIG. 5. Passage of a current pulse through any of the electromagnets in a direction such as to reverse the polarity of the core arm within the core passage thereof throws the core member in counterclockwise direction, as viewed in FIG. 5, for engaging selecting pawl 22 with a corresponding ratchet wheel 3 as shown in FIG. 2. Rotation of common reset cam 30 restores all of the core members to standby position by engagement of said cam with reset arms 23.

A significant feature of the embodiment of FIG. 5 is the provision of only two permanent magnets for control of a plurality of reeds, thereby simplifying the construction and reducing the weight thereof. Another feature is disposal of two like poles of the two permanent magnets proximate each other making it possible to use a common pole plate 56 for the two magnets, thereby further simplifying the construction and reducing the weight thereof.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An improvement in a printer mechanism for selecting for printing a character on a moving character support, said mechanism including an electromagnet coil having a core passage therethrough, a ratchet connected with said character support for controlling the movement thereof, wherein said improvement comprises a permanent magnet having a spaced-apart north and south poles generating a magnetic field, a shaft, a core member mounted on said shaft for rotation between first and second positions, said core member having a core arm of a ferromagnetic material and a pawl extending from said shaft in a direction substantially opposed to said core arm and including a pawl for engaging said ratchet when said core member is in said second position, said core arm, in part, lying within said core passage and adapted to reciprocate therein about said shaft and including a tip portion at the end of said core arm extending through said coil, said tip portion proximate one of said poles when said core arm is in said first position and proximate the other of said poles when said core arm is in said second position, said core arm in said first position being held to said one pole by said magnetic field in the absence of current flow through said electromagnet, and in said second position being held to said other pole by said magnetic field, said electromagnet being so connectable electrically that on activation thereof by a current pulse, said core arm becomes of the same polarity as said one pole and is repelled thereby for moving said arm toward and into engagement with the other of said poles, and for thereby engaging said pawl with said ratchet, and mechanical reset means for returning said core arm and core member to said first position and disengaging said pawl from said ratchet, and wherein said core member has a side arm of a ferromagnetic material extending from said core member at the region of said shaft in the direction of said core arm and further comprising a second permanent magnet disposed proximate the tip region of said side arm for attracting said side arm for pivoting said core member about said shaft from said first to said second position on activation of said electromagnet by a current pulse.

2. The improved printer mechanism as claimed in claim 1, wherein said second permanent magnet is so oriented that the tip of said side arm when said core member is in said first position is proximate a pole of polarity opposite to that of said permanent magnet proximate which the tip of said core arm is disposed.

3. The improved printer mechanism as claimed in claim 1, further comprising a single pole plate between said permanent magnet and said second permanent magnet, said magnets being disposed with poles of like polarity proximate each other whereby a single pole plate can serve for both magnets.

4. The improved printer mechanism as claimed in claim 3, wherein a plurality of core members, each having a core arm and a side arm both of ferromagnetic material, are mounted on said core shaft, each core member having an electromagnet corresponding thereto, the core arm of each core member passing through the coil of the corresponding electromagnet, said electromagnets being staggered in two lines termed first and second lines, so that of the electromagnets corresponding to any adjacent pair of core members one is in said first line and the other is in said second line, whereby the pitch distance between core members and thereby the pitch distance between lines printed by said printer mechanism can be decreased below that of a printer mechanism in which said electromagnets are in a single line.

5. The improved printer mechanism as claimed in claim 4, wherein said permanent magnet is singular in number and is disposed for receiving core arms passing through the cores of the electromagnets in said first line, henceforth termed first line core arms, and for receiving the side arms of the core members having core arms passing through the cores of the electromagnets in said second line, henceforth termed second line side arms, and for holding said first line core arms and said second line side arms proximate a pole of one polarity when said core members are in said first position, and said second permanent magnet is singular in number and is disposed for receiving core arms passing through the cores of the electromagnets in said second line, henceforth termed second line core arms, and for receiving the side arms of core members having core arms passing through the cores of the electromagnets in said first line, henceforth termed first line side arms, and for holding said second line core arms and first line side arms, when said core members are in said first position, proximate to a pole of polarity opposite to said one polarity.

6. The improved printer mechanism as claimed in claim 4, further comprising a single pole plate between said single permanent magnet and said second single permanent magnet, said magnets being disposed with one pole of said permanent magnet proximate one pole of said second permanent magnet, said proximate poles being of said same polarity, whereby said single pole plate can serve as a pole plate for both said permanent magnet and said second permanent magnet.

7. The improved printer mechanism as claimed in claim 4, wherein said permanent magnet and said second permanent magnet each has a pole plate at the pole thereof of opposite polarity to that of said proximate poles and single pole plate.

8. The improved printer mechanism as claimed in claim 7, wherein said permanent magnet and second permanent magnet and pole plates are so disposed that when said core members are in said first position, the tips of said first line core arms and said second line side arms are proximate said pole plate of opposite polarity of said permanent magnet and said second line core arms and said first line side arms are proximate said single pole plate and when said core members are in said second position, the tips of said first line core arms and said second line side arms are proximate said single pole plates of opposite polarity of said second permanent magnet.

* * * * *